United States Patent [19]

Wayland et al.

[11] 4,260,864

[45] Apr. 7, 1981

[54] VACUUM-TYPE CIRCUIT INTERRUPTER WITH AN IMPROVED CONTACT WITH AXIAL MAGNETIC FIELD COIL

[75] Inventors: Paul O. Wayland, Montour Falls, N.Y.; Joseph G. Gorman, Murrysville Borough; Roy E. Voshall, Loyalhanna Township, Westmoreland County, both of Pa.

[73] Assignee: Westinghouse Electric Corp., Pittsburgh, Pa.

[21] Appl. No.: 965,012

[22] Filed: Nov. 30, 1978

[51] Int. Cl.[3] ..... H01H 33/66

[52] U.S. Cl. ..... 200/144 B

[58] Field of Search ..... 200/144 B, 147 R

[56] References Cited

U.S. PATENT DOCUMENTS

| | | | |
|---|---|---|---|
| 3,158,722 | 11/1964 | Porter | 200/147 R |
| 3,321,599 | 5/1967 | Lee | 200/144 B |
| 3,345,484 | 10/1967 | Polinko, Jr. et al. | 200/144 B |
| 3,372,258 | 3/1968 | Porter | 200/144 B |
| 3,372,259 | 3/1968 | Porter | 200/144 B |
| 3,469,050 | 9/1969 | Robinson et al. | 200/147 R X |
| 3,764,764 | 10/1973 | Takasuna et al. | 200/144 B |
| 3,818,164 | 6/1974 | Mizutani et al. | 200/144 B |
| 3,823,287 | 7/1974 | Bettge | 200/144 B |
| 3,852,555 | 12/1974 | Schuöker et al. | 200/144 B |
| 3,935,406 | 1/1976 | Murano et al. | 200/144 B |
| 3,946,179 | 3/1976 | Murano et al. | 200/144 B |
| 4,117,288 | 9/1978 | Gorman et al. | 200/147 R X |
| 4,196,327 | 4/1980 | Kurosawa et al. | 200/144 B |

*Primary Examiner*—James R. Scott

*Attorney, Agent, or Firm*—W. G. Sutcliff

[57] ABSTRACT

An improved vacuum-type circuit interrupter has arc contacts which have integral axial magnetic field generating means as part of the arc contact. The axial field generating means comprises a plurality of partial coil turn portions which form an effective single turn coil disposed between a supporting plate and an arcing contact portion. The coil turns are electrically in series between the conductive support rod lead-in and the arcing contact perimeter portion. The supporting plate and a plurality of support pins, each of which are of high strength, low conductivity material support the partial coil turn portions and the arc contact without diverting substantial current from the coil turn portions. The axial magnetic field generating means may be structurally a part of both contacts or only one of the contacts.

9 Claims, 3 Drawing Figures

VACUUM-TYPE CIRCUIT INTERRUPTER WITH AN IMPROVED CONTACT WITH AXIAL MAGNETIC FIELD COIL

BACKGROUND OF THE INVENTION

The present invention relates to vacuum-type circuit interrupters such as are used in electrical power transmission and distribution, and switchgear assemblies. In a vacuum-type interrupter a pair of current carrying contacts are moved apart to effect arcing and then circuit interruption.

The use of magnetic forces to act upon the arc current between the contacts is well known in the art. It has been the general practice to design the contact structure such that a magnetic field is generated which interacts with the arc current to drive the arc current circumferentially around the contact surface. More recent developments have indicated that a magnetic field which is directed along the arc current axial path, and which axial field is parallel to the arc current, is advantageous in that it produces a diffuse arc. The more diffuse the arc, the less the erosion of contact material upon successive operations, and in general, the greater the capability of the device to handle higher power interruptions reliably.

The axial magnetic field in such devices was originally generated externally of the sealed vacuum envelope. Recent work has focused on designing a contact structure which incorporates axial field generating means as part of the contact structure, or closely associated with the contact. A recent example of such structures is U.S. Pat. No. 4,117,288, issued Sept. 26, 1978 and owned by the assignee of this invention.

A variety of other axial field contact interrupter devices are known in the art, but are relatively complicated to manufacture or offer limited current carrying capability.

It is important that any vacuum interrupter which incorporates an axial field means, as part of the contact structure, be as structurally simple as possible to improve reliability and lower manufacturing cost. The contacts must be rugged to withstand the closing action in which the contacts are slammed together, and to permit repetitive opening and closing.

In an axial field contact in which the current is passed through the field generating conductor the structure should be such as to minimize losses while carrying significant currents.

SUMMARY OF THE INVENTION

A vacuum type circuit interrupter is detailed with a simplified axial magnetic field generating contact structure. The contact structure includes a high conductivity arc contact member which is spaced from a relatively low conductivity supporting base plate by low conductivity support posts. An axial magnetic field generating means is disposed between the supporting base plate and the arc contact. This axial magnetic field generating means comprises a generally planar, high conductivity member having a central web portion and a plurality of partial turn coil portions extending from the central web portion. The partial turn coil portions are directed in a common circumferential direction. The extending ends of the coil turn portions extend toward and are electrically serially connected between the support post conductor and the peripheral portions of the contact member, with the partial turn coil portions being electrically in parallel with respect to each other.

DESCRIPTION OF THE PREFERRED EMBODIMENTS

Figure 1:
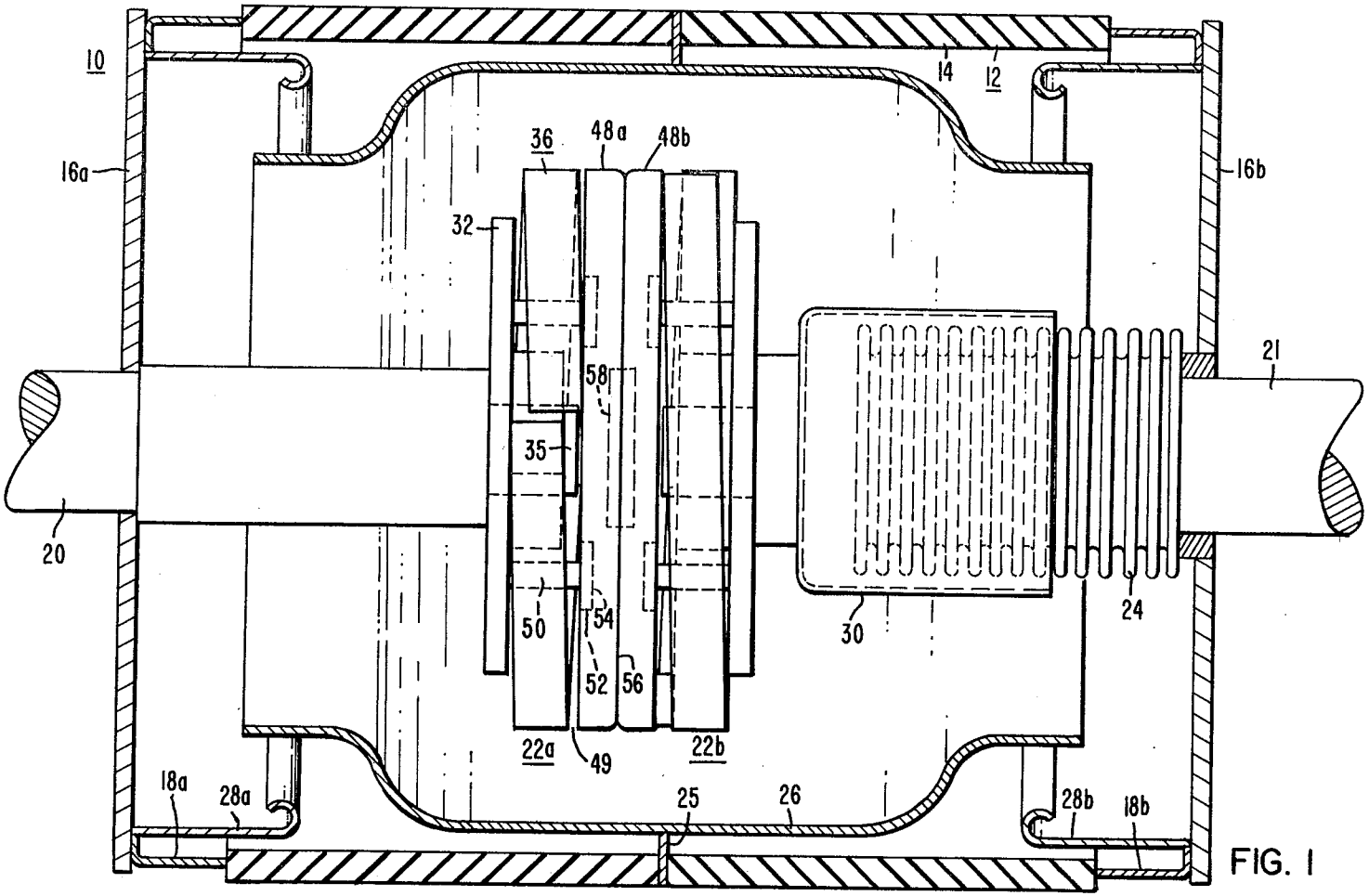
FIG. 1 is a side elevation view partly in section taken through a vacuum-type interrupter of the present invention which has the improved contact with an axial field generating coil made part of the contact structure in a series electrical path with the arcing portion of the contact.

The present invention can be best understood by reference to the embodiment illustrated in FIG. 1. The vacuum-type circuit interrupter 10 comprises a hermetically sealed, evacuated envelope 12. The envelope 12 includes cylindrical insulating body 14, opposed conductive end plates 16*a*, and 16*b*, which are sealed to the ends of the cylindrical insulating body 14, by annular seal means 18*a*, 18*b*. A conductive lead-in and contact support rod 20 is sealed through end plate 16*a* and supports fixed contact assembly 22*a*. Another conducive lead-in and contact support rod 21 is sealed in movable fashion through end plate 16*b* via bellows seal assembly 24. Contact support rod 21 supports the movable contact assembly 22*b*.

A plurality of arc shields are disposed within the envelope to intercept evolved material from the arcing surface of the contacts. Thus, generally cylindrical center shield 26 and overlapping annular end shields 28*a*, 28*b* prevent vaporized material from impinging on the insulation body or the seal areas. A generally cup-shaped shield 30 is disposed over the bellows 24 to protect it from vaporized contact material. In the embodiment shown in FIG. 1, the insulating body 14 has a support member 25 extending inward therefrom to support the center shield 26.

The fixed contact assembly 22*a* and the movable contact assembly 22*b* have the same structure as will be described by reference to FIGS. 1 and 2. Each of these contact assemblies 22*a*, 22*b* are electrically connected to and supported from the extending end of the respective conductive support rod 20, 21.

The contact assemblies 22*a*, 22*b* each comprise a relatively low conductivity supporting base plate 32. A central aperture 34 is provided through this base plate 32, with the reduced diameter end portion 35 of the support rods 20 or 21 fitting in and passed through this aperture 34. An axial magnetic field generating means 36 is supported by the base plate 32.

The axial magnetic field generating means 36 is what amounts to a single turn generally planar coil made up of a plurality of partial coil turns that are in series with the conductive support rod 20, so that all current passing through the interrupter passes through the means 36. The means 36 comprises a circular central web portion 38 having an aperture 40 therein within which the extending end of the respective support rod 20, 21 terminates and is electrically connected as by brazing. In this embodiment two half-coil turns are employed, but could easily be third or quarter turn portions to make up the complete effective single turn coil. A plurality of radial arms 42a, 42b extend from the central web 38. Arcuate, circumferentially directed partial turn portions 44a, 44b extend respectively from the radial arms 42a, 42b. The extending ends 46a, 46b of the partial turn portions extend upwardly toward and are electrically connected to the disc arc contact 48a, at spaced perimeter portions of the arc contact 48a, as by brazing the shaded end portions. The web portion 38 and the radial arms 42a, 42b are brazed to the supporting base plate 32 as suggested by the shading on plate 32 in FIG. 2. The coil turn portions 44a, 44b, as well as the radial arms 42a, 42b of axial field generating means 36 are spaced from arc contact 48a with a gap 49 therebetween seen in FIG. 1.

The arc contacts 48a, 48b are disc-like members which have the same diameter as that defined by the partial turns of the axial field generating means. A plurality of low conductivity support posts, here four symmetrically spaced identical posts 50, extend between the support base plate 32 and the back side of the arc contacts 48a and 48b. The support posts 50 are brazed at each end to effectively support the arc contact. A plurality of symmetrically spaced countersink areas 55 may be provided in the surface of the support plate 32 into which the support posts 50 respectively fit for alignment purposes during fabrication, with the posts being brazed in place. An enlarged head 52 is provided at one end of the support posts and fits in a countersink area 54 provided in the back of the arc contact. The front or arcing surface 56 of the arc contact has a central depressed portion 58 such that the initial arcing that occurs between the contacts when they are moved apart occurs away from the center of the arc contact. The arc contact is made of a high conductivity material such as a copper-chromium contact material.

The axial field generating means 36 is formed of a high conductivity material such as oxygen free high conductivity OFHC copper. The base plate 32 and the support posts 50 are formed of high strength, relatively low conductivity material such as stainless steel. The relatively high conductivity ratio between stainless steel and the OFHC copper ensures that the substantial portion of the current passes through the axial field generating means which is electrically in series between the support rod and the arc contact.

Figure 2:
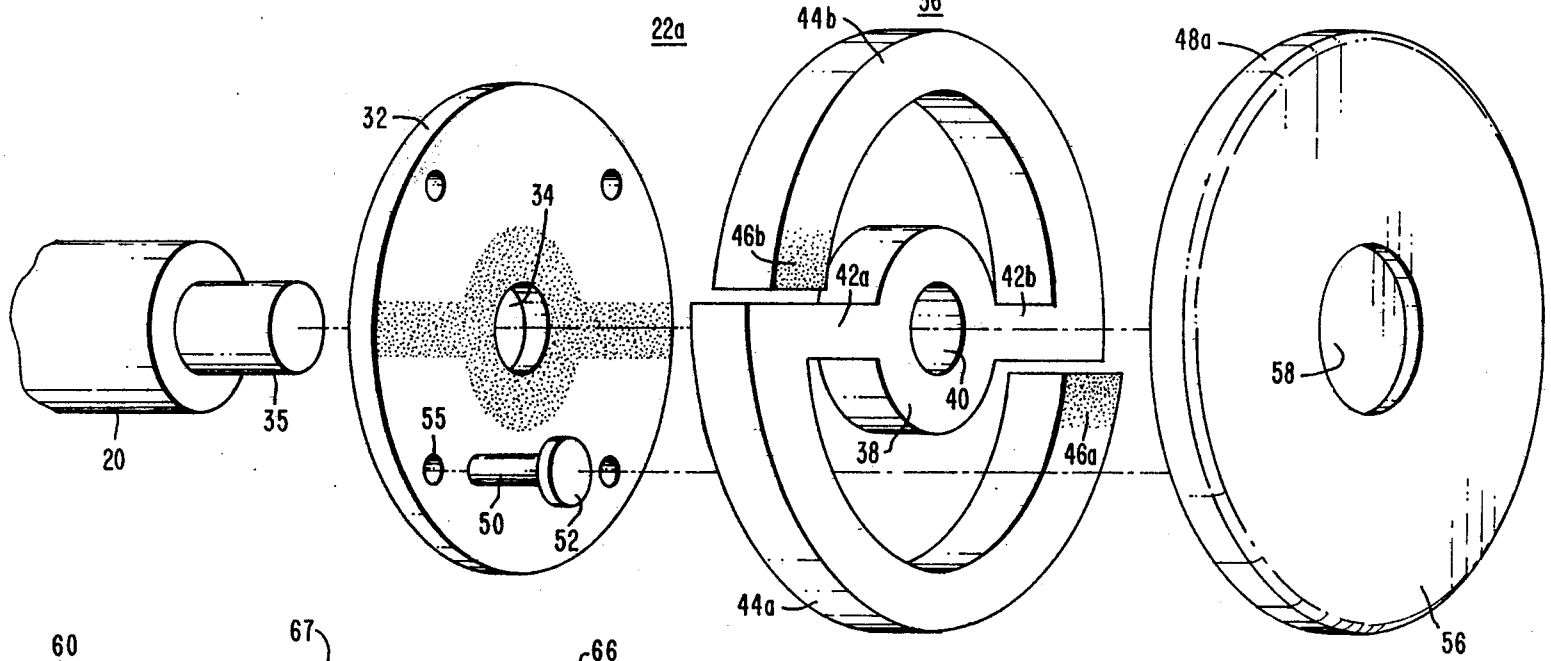
FIG. 2 is an exploded perspective view of one of the identical contacts seen in FIG. 1, and illustrating the portions of the contact structure prior to assembly.
Figure 3:
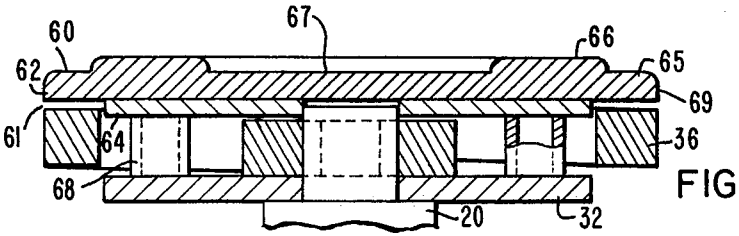
FIG. 3 is a side elevation view of another embodiment contact structure per the present invention.

In the embodiment of FIG. 3, the support rod, base plate and the axial field generating means are as set forth in the embodiment of FIGS. 1 and 2. In the FIG. 3 embodiment the arc contact 60 is modified to comprise a thinned disc 62 of the high conductivity material, and a backing or support disc 64 of low conductivity, high strength material such as stainless steel is butted on the back surface of the high conductivity disc 62. The backing or support disc 64 has a diameter less than that of the arcing disc 62 to permit the extending upwardly ends 46a, 46b of the partial turn portions 44a, 44b to be connected to the perimeter portion of the arcing disc 62. The arcing disc 62 has a front or arc surface 65 which has an annular raised portion 66 spaced between the center 67 and the perimeter portion 69. The stainless steel support posts 68 are here shown as tubular members which extend between the stainless steel supporting base plate 32 and the backing or support disc 64. The axial field generating means 36 is spaced from the arc contact 60 with gap 61 therebetween, except where the upwardly extending ends 46a, 46b are in contact with the perimeter of arc contact 60.

The reduced mass of the high conductivity arcing disc 62 ensures that the axial magnetic field will penetrate the arc contact 60 and establish the necessary magnetic field between the contacts as the arc forms. It is important that the magnetic field permeate through the arc contact 60 and be effective immediately as the arc forms to keep it diffuse and not let an intense arc form. If the arc contact has a high conductivity, the rise time of the magnetic field between the contacts will be delayed over a longer period. The stainless steel backing disc 64 strengthens the thinned contact 62, and with this reduced conductivity the magnetic field more quickly permeates through the contact to prevent intense arc spot formation as the contacts are moved apart.

The axial field generating means 36 should be properly dimensioned such that an axial magnetic field of sufficient strength to keep the arc diffuse is produced in the arcing volume between the contacts as they are moved apart. An axial field of at least about $4\times10^{-3}$ teslas has been found effective. The axial magnetic field should be relatively symmetrical and uniform and to this end the respective contacts 22a and 22b are rotated 90 degrees relative to each other so that the radial arms 42a, 42b of one contact are transverse to the radial arms of the opposed contact. This transverse relationship of the radial arm portions 42a, 42b of the axial field generating means 36 of one contact is not seen in the drawings, but can be understood by reference to FIG. 2 which shows one contact 22a. The axial field generating means and particularly the radial arm portions thereof of the opposed contact would be transversely directed relative to radial arm portions 42a, 42b. This will determine that the gaps in the coil turns between end portions 46a, 46b and the radial arms of each coil are offset in the opposed contacts so that there will not be aligned low field regions at which an intense arc might form. The coil turns of the opposed contacts are directed in the same circumferential direction to provide an additive axial field which is parallel to the arc path.

The vacuum interrupter devices of the present invention permit achievement of high current operating ratings. By way of example, a device per FIGS. 1 and 2 with a 4.5 inch contact is rated at about 11.5 kV and 48 kA RMS operation, and meets the American National Standards Institute specification C37.06-1971. In this device, the axial field strength is about $9\times10^{-3}$ teslas per kilo-amp. The current carrying capacity of the device can be increased by providing heat transfer means associated with the conductive support rods outside the device envelope.

It has also been discovered that a vacuum interrupter with superior high voltage withstand capability can be provided by virtue of the axial field contacts of the present invention. The contacts can be opened to a much wider spacing gap between the contacts, such as about one inch, to achieve a high voltage withstand capability. Such a gap is more than about twice the standard open circuit spacing between contacts in conventional vacuum interrupters. The provision of the axial magnetic field permits this wide spacing between the opened contacts without formation of an intense arc which would be expected between such widely spaced contacts.

The axial magnetic field may be produced by having a single contact per FIG. 2 with a field generating coil serially connected as part of the contact, and a conventional butt or disk-type contact as the opposed contact.

The axial field generating contact would preferably be the fixed contact and the plain butt type contact would be the movable contact since it would be lighter to simplify the operating mechanism requirements. The axial magnetic field produced from a single contact with a field generating means still produce an axial field in the gap between the contacts, but this field would have more of a radial field component or fringing field in the proximity of the plain butt type contact. The butt type contact would have a diameter approximately equal to the arc contact portion of the axial field contact.

We claim:

1. A vacuum-type circuit interrupter which includes a housing which is evacuated and sealed, with a pair of relatively movable contacts sealed through and supported within the housing, at least one of the contacts being movable between a closed position in conductive engagement with the other contact, and an open position spaced apart from the other contact with an arc gap therebetween across which an arc forms during circuit interruption, the improvements wherein at least one of the contacts includes axial magnetic field generating means for maintaining a diffuse arc, which contact comprises:

(a) a high conductivity arc contact member;

(b) a relatively low conductivity supporting base plate which is spaced from the arc contact member with a plurality of low conductivity support posts extending from the support base plate to the arc contact member, the posts being disposed intermediate the aligned centers of the base plate and the arc contact member and their perimeters, the supporting base plate having a central aperture through which a high conductivity contact support rod extends;

(c) axial magnetic field generating means disposed between the supporting base plate and the arc contact member, the axial field generating means comprises a generally planar high conductivity member having a central web portion and a plurality of partial turn coil portions extending from the central web portions, the partial turn coil portions are directed in a common circumferential direction, with the extending ends of the coil portions extending toward and electrically connected to peripheral portions of the contact member, the partial turn coil portions together form an axial magnetic field coil which produce a substantially uniform axial magnetic field over the arc contact area.

2. The vacuum-type circuit interrupter set forth in claim 1, wherein the arc contact member includes an arcing surface in which the central portion of the arcing surface is recessed from the annular arcing surface.

3. The vacuum-type circuit interrupter set forth in claim 1, wherein the axial magnetic field generating means comprises two half turn coil portions.

4. The vacuum-type circuit interrupter set forth in claim 1, wherein the axial magnetic field generated by both contacts is at least about $4\times10^{-3}$ teslas per kiloampere of arc current.

5. The vacuum-type circuit interrupter set forth in claim 1, wherein the plurality of support posts between the supporting base plate and the arc contact member are symmetrically spaced.

6. The vacuum-type circuit interrupter set forth in claim 1, wherein a low conductivity high strength support disc is mounted on the back surface of the arc contact member which has a reduced thickness, and wherein this support disc has a diameter which is less than the partial turn coil portions, the extending ends of the partial turn coil portions being electrically connected to the arc contact member beyond the periphery of the support disc.

7. The vacuum-type circuit interrupter set forth in claim 1, wherein both contacts are identical having axial magnetic field generating means with the coil turn portions of each of the contacts directed to provide an additive axial magnetic field in the gap between the spaced apart contacts.

8. The vacuum-type circuit interrupter set forth in claim 7, wherein the opposed contacts are rotated relative to each other so that the central web portions of the opposed contacts are disposed transverse to each other.

9. A vacuum-type circuit interrupter which includes an evacuated envelope, with a pair of contact supporting conductors sealed through and supported within the envelope, at least one of the contacts and supporting conductor being movable between a closed position in conductive engagement with the other contact, and an open position spaced apart from the other contact with an arc gap therebetween across which an arc forms during circuit interruption, the improvement wherein the contacts are identical and include axial magnetic field generating means for keeping the arc diffuse, which contacts comprise:

(a) a high conductivity arc contact member;

(b) a relatively low conductivity supporting base plate which is spaced from the arc contact member with a plurality of low conductivity support posts extending from the support base plate to the arc contact member, the posts being disposed intermediate the aligned centers of the base plate and the arc contact member and their perimeters, the supporting base plate having central aperture through which a high conductivity contact support rod extends;

(c) axial magnetic field generating means comprising a central web portion which is electrically connected to the extending end of the high conductivity contact support rod, with radially arms extending from the central web portion which central web portion and the radially extending arms seated on and supported by the supporting base plate and spaced from the contact member, and wherein arcuate peripheral arms extend from the ends of the radially extending arms in a common circumferential direction generally in a common plane with the web portion and the radially extending arms, with the ends of the peripheral arms extending toward the contact member and electrically connected thereto at spaced-apart peripheral portions of the contact member.

* * * * *